US011725337B2

(12) United States Patent
Pinto et al.

(10) Patent No.: US 11,725,337 B2
(45) Date of Patent: Aug. 15, 2023

(54) FLAME RETARDANT MATERIAL AND SYSTEM

(71) Applicant: GM GLOBAL TECHNOLOGY OPERATIONS LLC, Detroit, MI (US)

(72) Inventors: Nicholas W. Pinto, Shelby Township, MI (US); Anne M. Dailly, West Bloomfield, MI (US); Kuo-Huey Chen, Troy, MI (US); Nathan Thompson, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 25 days.

(21) Appl. No.: 17/223,380

(22) Filed: Apr. 6, 2021

(65) Prior Publication Data

US 2022/0316131 A1 Oct. 6, 2022

(51) Int. Cl.
*D06M 13/50* (2006.01)

(52) U.S. Cl.
CPC ..... *D06M 13/50* (2013.01); *D06M 2200/30* (2013.01)

(58) Field of Classification Search
CPC ..... D06M 13/50; D06M 2200/30
See application file for complete search history.

(56) References Cited

U.S. PATENT DOCUMENTS

2008/0111114 A1 5/2008 Gilbert
2016/0280879 A1* 9/2016 Brannum ..... D06M 11/48
2017/0341054 A1 11/2017 Glover et al.
2018/0023002 A1* 1/2018 Gilbert ..... D06M 13/148 252/605
2018/0226682 A1 8/2018 Lu et al.

FOREIGN PATENT DOCUMENTS

| | | | |
|---|---|---|---|
| CN | 1849420 | A | 10/2006 |
| CN | 103338858 | A | 10/2013 |
| CN | 103501891 | A | 1/2014 |
| CN | 103906825 | A | 7/2014 |
| CN | 104403186 | A | 3/2015 |
| CN | 104744840 | A | 7/2015 |
| CN | 109320910 | A | 2/2019 |
| CN | 109400959 | A | 3/2019 |
| CN | 111138822 | A | 5/2020 |
| JP | 2011198601 | A | 10/2011 |
| WO | 8304041 | A1 | 11/1983 |

* cited by examiner

*Primary Examiner* — Cephia D Toomer
(74) *Attorney, Agent, or Firm* — Quinn IP Law

(57) ABSTRACT

Systems, apparatuses, and methods are described that combine a sorbent containing a flame retardant with a substrate, which is capable of responding to temperature increases to prevent, suppress, delay the spread of, or otherwise mitigate a proximal thermal event. A flame retardant system has a flame retardant material that is incorporated into a matrical sorbent material, which is incorporated into a substrate. The matrical sorbent material is configured to release the flame retardant material upon exposure to an elevated temperature, e.g., a temperature that is greater than 300° C. in one embodiment.

18 Claims, 1 Drawing Sheet

FLAME RETARDANT MATERIAL AND SYSTEM

INTRODUCTION

Devices and systems may experience thermal events. There may be a need to prevent, suppress, delay the spread of, and/or otherwise mitigate a thermal event.

SUMMARY

The concepts described herein are embodied in systems, apparatuses, and methods that combine a sorbent containing a flame retardant with a substrate, which is capable of responding to temperature increases to prevent, suppress, delay the spread of, or otherwise mitigate a proximal thermal event.

One aspect of the disclosure is a flame retardant system having a flame retardant material that is incorporated into a matrical sorbent material, which is incorporated into a substrate. The matrical sorbent material is configured to release the flame retardant material upon exposure to an elevated temperature, e.g., a temperature that is greater than 300° C. in one embodiment.

Another aspect of the disclosure includes the flame retardant material being huntite in combination with hydromagnesite in one embodiment, or huntite in combination with aluminum hydroxide in one embodiment, or huntite in combination with magnesium hydroxide in one embodiment.

Another aspect of the disclosure includes the matrical sorbent material being a Metal Organic Framework (MOF) material.

Another aspect of the disclosure includes the MOF material being a microporous aluminum-based MOF.

Another aspect of the disclosure includes the microporous aluminum-based MOF having a pore volume of 1.0 mL/g and a decomposition temperature near 300° C. to release the flame retardant material.

Another aspect of the disclosure includes the MOF material being a zirconium-based MOF.

Another aspect of the disclosure includes the zirconium-based MOF having a pore volume of 1.0 mL/g and a decomposition temperature near 300° C. to release the flame retardant material.

Another aspect of the disclosure includes the MOF material being a thermally stable MOF having a pore volume of 3.0 mL/g and a decomposition temperature near 300° C. to release the flame retardant material.

Another aspect of the disclosure includes the MOF material being an isoreticular MOF having a pore volume of 3.0 mL/g and a decomposition temperature near 300° C. to release the flame retardant material.

Another aspect of the disclosure includes the matrical sorbent material being a zeolite material having a pore volume of at least 1.0 mL/g and a release temperature near 300° C. to release the flame retardant material.

Another aspect of the disclosure includes the matrical sorbent material being configured to release the flame retardant material upon exposure to a temperature that is greater than 300° C.

Another aspect of the disclosure includes the substrate being a meshed fabric.

Another aspect of the disclosure includes the substrate being a liquified coating material.

Another aspect of the disclosure includes the liquified coating material incorporating the flame retardant material being incorporated into the matrical sorbent material and applied to a composite material.

Another aspect of the disclosure includes the liquified coating material incorporating the flame retardant material being incorporated into the matrical sorbent material and applied to a solid surface.

Another aspect of the disclosure includes the substrate having the flame retardant material that is incorporated into the matrical sorbent material being a cable sheath.

Another aspect of the disclosure includes the substrate having the flame retardant material that is incorporated into the matrical sorbent material being a thin film arranged on a flexible tape material.

Another aspect of the disclosure includes the substrate having the flame retardant material that is incorporated into the matrical sorbent material being a thin film arranged on a foil wrap material.

As such, the substrate may be a material wrap, e.g., electrical tape, foil wrap. The substrate may be foam insulation. The substrate may be a fabric. The substrate may be paint or a coating on wire sheaths for a wiring harness including electrical cable and connectors. The substrate may be a housing for a fuel tank and lines when employed on a vehicle.

The above summary is not intended to represent every possible embodiment or every aspect of the present disclosure. Rather, the foregoing summary is intended to exemplify some of the novel aspects and features disclosed herein. The above features and advantages, and other features and advantages of the present disclosure, will be readily apparent from the following detailed description of representative embodiments and modes for carrying out the present disclosure when taken in connection with the accompanying drawings and the claims.

BRIEF DESCRIPTION OF THE DRAWINGS

One or more embodiments will now be described, by way of example, with reference to the accompanying drawings, in which.

The appended drawings are not necessarily to scale, and may present a somewhat simplified representation of various preferred features of the present disclosure as disclosed herein, including, for example, specific dimensions, orientations, locations, and shapes. Details associated with such features will be determined in part by the particular intended application and use environment.

DETAILED DESCRIPTION

The components of the disclosed embodiments, as described and illustrated herein, may be arranged and designed in a variety of different configurations. Thus, the following detailed description is not intended to limit the scope of the disclosure, as claimed, but is merely representative of possible embodiments thereof. In addition, while numerous specific details are set forth in the following description in order to provide a thorough understanding of the embodiments disclosed herein, some embodiments can be practiced without some of these details. Moreover, for the purpose of clarity, certain technical material that is understood in the related art has not been described in detail in order to avoid unnecessarily obscuring the disclosure. For purposes of convenience and clarity only, directional terms such as top, bottom, left, right, up, over, above, below, beneath, rear, and front, may be used with respect to the drawings. These and similar directional terms are not to be construed to limit the scope of the disclosure. Furthermore, the disclosure, as illustrated and described herein, may be practiced in the absence of an element that is not specifically disclosed herein.

The following detailed description is merely exemplary in nature and is not intended to limit the application and uses. Furthermore, there is no intention to be bound by any expressed or implied theory presented herein.

As used herein, the term "system" may refer to one of or a combination of elements in the form of materials and components that are arranged to provide the described functionality.

All numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; about or reasonably close to the value; nearly). If the imprecision provided by "about" is not otherwise understood in the art with this ordinary meaning, then "about" as used herein indicates at least variations that may arise from ordinary methods of measuring and using such parameters.

Figure 1:
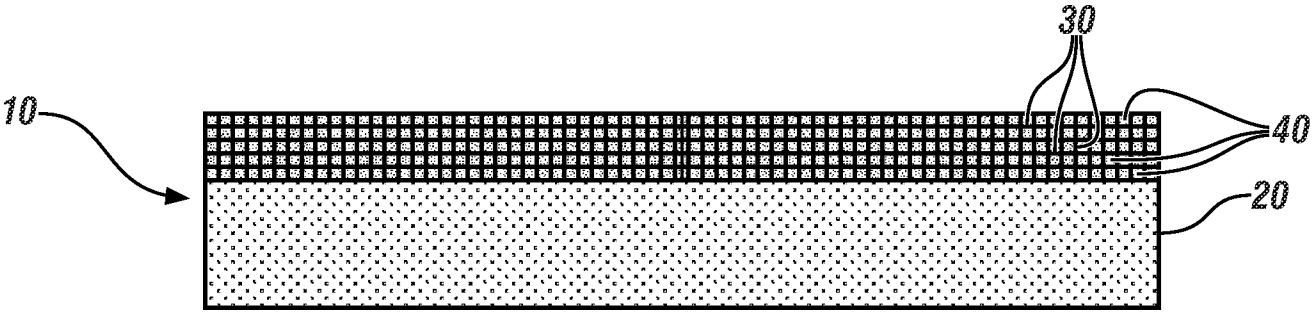
FIG. 1 schematically illustrates a side view of a flame retardant system, in accordance with the disclosure.

Referring now to the drawings, which are provided for the purpose of illustrating certain exemplary embodiments only and not for the purpose of limiting the same, FIG. 1 schematically illustrates an embodiment of a flame retardant system 10 that includes a substrate 20 having a matrical sorbent material 30 with a flame retardant material 40 being incorporated by adsorption or another process. The matrical sorbent material 30 is configured to release the flame retardant material 40 upon exposure to an elevated temperature to prevent, suppress, delay the spread of, or otherwise mitigate a proximal thermal event. The elevated temperature is a temperature that is greater than 300° C. in one embodiment.

The flame retardant material 40 includes substances that are intended to prevent a thermal event and/or slow the spread of a thermal event in an area. Flame retardants reduce the flammability of materials by either physically blocking a thermal event or by initiating a chemical reaction to stop the thermal event. There are several ways in which the combustion process can be retarded, including cooling the material by a chemical reaction, forming a protective layer that prevents the underlying material from igniting, or by dilution, wherein a retardant releases water and/or carbon dioxide while burning. The flame retardant material 40 employed herein is selected based upon its molecular size and configuration, and its ability to be adsorbed by, stably contained by, and desorbed or otherwise released by an embodiment of the matrical sorbent material 30.

In one embodiment, the flame retardant material 40 includes huntite in combination with hydromagnesite. In one embodiment, the flame retardant material 40 includes huntite in combination with aluminum hydroxide. In one embodiment, the flame retardant material 40 includes huntite in combination with magnesium hydroxide. When heated, aluminum hydroxide dehydrates to form aluminum oxide (alumina, $Al_2O_3$), releasing water vapor in the process. This reaction absorbs a great deal of heat, cooling the material into which it is incorporated. Additionally, the residue of alumina forms a protective layer on the material's surface. Mixtures of huntite and hydromagnesite work in a similar manner. They endothermically decompose releasing both water and carbon dioxide, giving flame retardant properties to the materials in which they are incorporated.

Alternatively, other flame retardant materials may be employed, including materials containing bromine, chlorine, phosphorus, nitrogen, metals, boron, etc.

Alternatively, or in addition, the flame retardant material 40 may be configured to neutralize, filter out, and/or adsorb toxins that may be generated by a thermal event.

A sorbent is a material that has the properties of collecting and retaining molecules of another substance, e.g., a liquid or a gas, by sorption. A matrical sorbent material is a sorbent material having a matrix structure that is able to adsorb another material at a first temperature condition, e.g., at or near an ambient condition, and release the adsorbed material upon exposure to an elevated temperature (above ambient) by material decomposition and/or material degradation. The matrical sorbent material 30 described herein is a sorbent material having a matrix structure that is able to adsorb the flame retardant material 40 at ambient temperature, and release the flame retardant material 40 upon exposure to an elevated temperature, e.g., wherein the temperature is at or near 300° C. It is appreciated that the temperature at which the matrical sorbent material 30 releases the flame retardant material 40 may be less than a desorption temperature.

In one embodiment, the matrical sorbent material 30 is a microporous material. Microporous materials are solids containing interconnected pores of less than 2 nm in size. Thus, they possess large surface areas, e.g., 300-3500 $m^2/g$ as measured by gas adsorption. Examples of microporous materials include zeolites and metal organic frameworks (MOFs). MOFs are metal ions or clusters that are coordinated to organic ligands to form one-, two-, or three-dimensional structures with a well-defined pore network for molecular transport, separation, and storage. The skeletal network can facilitate and catalyze molecular reaction and transformation.

In one embodiment, the matrical sorbent material 30 is a Metal Organic Framework (MOF) material in the form of microporous aluminum-based MOF, e.g., MIL-53. The MOF material of MIL-53 has a structure with inorganic [M-OH] chains, which are connected to four neighboring inorganic chains by therephthalate-based linker molecules. Each metal center is octahedrally coordinated by six oxygen atoms. Four of these oxygen atoms originate from four different carboxylate groups and the remaining two oxygen atoms belong to two different μ-OH moieties, which bridge neighboring metal centers. The resulting framework structure contains one-dimensional diamond-shaped pores. The structure of MIL-53 is flexible, allowing the pore cross-sections to change reversibly in response to external stimuli, e.g., temperature.

In one embodiment, the matrical sorbent material 30 has a maximized pore volume. In one embodiment, the matrical sorbent material 30 has a pore volume that is at least 1.0 mL/g to maximize the volume or mass of flame retardant material 40 that is adsorbed. Stated another way, the matrical sorbent material 30 has a pore volume that is greater than or equal to 1.0 mL/g to maximize the volume or mass of flame retardant material 40 that is adsorbed. In one embodiment, the matrical sorbent material 30 has a pore volume that is greater than 3.0 mL/g to maximize the volume or mass of flame retardant material 40 that is adsorbed. Stated another way, the matrical sorbent material 30 has a pore volume that is accommodative of molecules of an embodiment of the adsorbed flame retardant material 40.

In one embodiment, the matrical sorbent material 30 is MOF-210, which has a pore volume that is in the order of magnitude of 3.6 mL/g. Pore volume, also known as an internal void volume, is an important characteristic that can be used to determine the matrical sorbent material's permeability to guest molecules, adsorption capacity, and other properties.

In one embodiment, the matrical sorbent material 30 in the form of microporous aluminum-based MOF having a pore volume of at least 1.0 mL/g and a decomposition temperature near 300° C., which allows it to release the flame retardant material 40.

In one embodiment, the matrical sorbent material 30 is a zirconium-based MOF, e.g., UiO-66 or UiO-67.

In one embodiment, the zirconium-based MOF has a pore volume of at least 1.0 mL/g and a decomposition temperature near 300° C. to release the flame retardant material.

In one embodiment, the matrical sorbent material 30 is a thermally stable MOF, e.g., an Al-based MOF having a pore volume that is at or about 1.0 mL/g, and a decomposition temperature near 300° C. to release the flame retardant material 40. In one embodiment, the Al-based MOF is MIL-53.

In one embodiment, the matrical sorbent material 30 comprises an isoreticular MOF having a pore volume of at least 3.0 mL/g and a decomposition temperature near 300° C. to release the flame retardant material 40. Reticular chemistry refers to linking symmetrical building units, e.g., secondary building units or SBUs, into extended porous frameworks with strong covalent bonds. For a given shape, or pair of shapes, there is a small number of possible high-symmetry topologies that form the prime targets of designed synthesis. In particular, structures with one kind of link ("edge-transitive nets") are favorable. Accordingly, for a given shape, a series of compounds may be prepared with the same topology but differing in the nature and size of the links to form an isoreticular series. Isoreticular means the size of the linker (organic ligand) is varied to extend the size of the pores.

In one embodiment, the matrical sorbent material 30 is a zeolite material having a pore volume of at least 1.0 mL/g and a release temperature near 300° C. in order to release the flame retardant material. Another aspect of the disclosure includes the matrical sorbent material being a zeolite material having a pore volume of at least 1.0 mL/g and a release temperature near 300° C. to release the flame retardant material. The zeolite does not decompose at 300° C., but is able to release the flame retardant material 40.

In one embodiment, the matrical sorbent material 30 is configured to release the flame retardant material 40 upon exposure to a temperature that is greater than 300° C.

The substrate 20 provides a structural support for the matrical sorbent material 30 and the flame retardant material 40. The substrate 20 may be a material wrap, e.g., electrical tape, foil wrap in one embodiment. The substrate 20 may be foam insulation in one embodiment. The substrate 20 may be a woven fabric in one embodiment. The substrate 20 may be liquified paint or coating material that is applied on wire sheaths for a wiring harness including electrical cable and connectors, in one embodiment. The substrate 20 may be a housing for a fuel tank and lines, in one embodiment.

When the substrate 20 is a woven fabric, the matrical sorbent material 30 can be incorporated into the yarn of the woven fabric, with the flame retardant material 40 being adsorbed by the matrical sorbent material 30 after the woven fabric has been created.

The liquified coating material incorporating the flame retardant material 40 that is incorporated into the matrical sorbent material 30 is applied to a composite material in one embodiment.

The liquified coating material incorporating the flame retardant material that is incorporated into the matrical sorbent material is applied to a solid surface, such as metal, glass, wood, plastic, etc.

In one embodiment, the substrate 20 incorporating the flame retardant material 40 that is incorporated into the matrical sorbent material 30 is a cable sheath that provides electrical insulation for a signal lead wire or an electric power lead wire. Alternatively, the substrate 20 incorporating the flame retardant material 40 that is incorporated into the matrical sorbent material 30 is a thin film that is arranged on a flexible tape material. Alternatively, the substrate 20 incorporating the flame retardant material 40 that is incorporated into the matrical sorbent material 30 is a thin film that is arranged on a foil wrap material.

Figure 2:
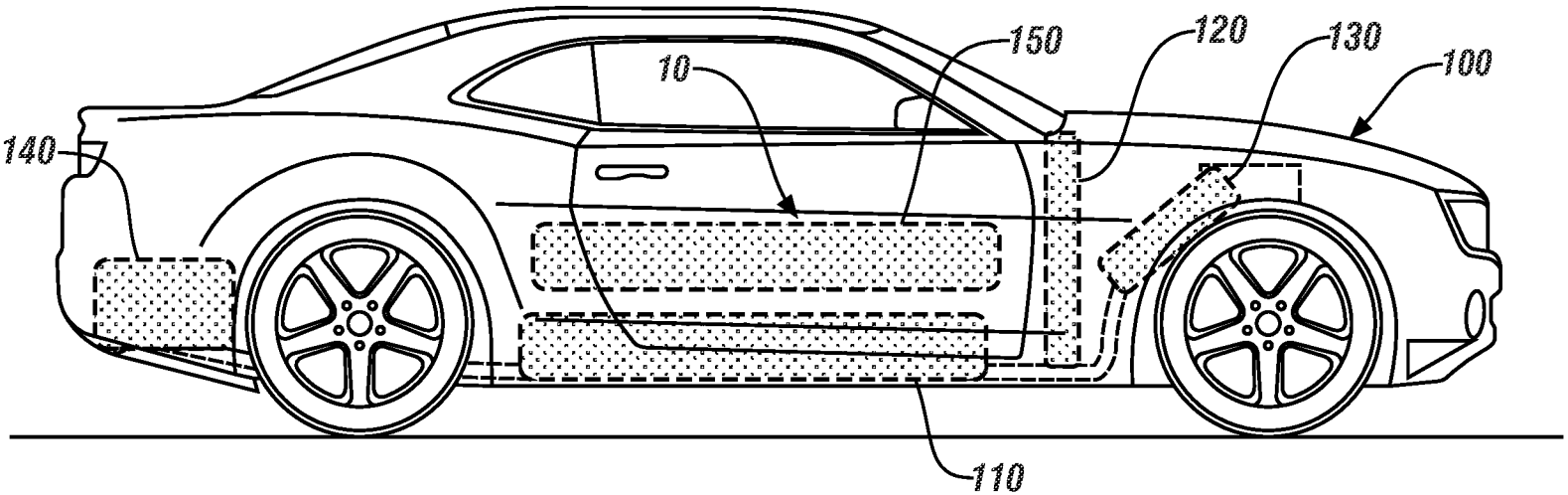
FIG. 2 schematically illustrates a side view of a vehicle, in accordance with the disclosure.

FIG. 2 schematically shows a side-view of a vehicle 100 to indicate placement of various implementations of embodiments of the flame retardant system 10 that is described with reference to FIG. 1. This includes a wrap and/or intercell elements for a high-voltage battery 110, an engine/cabin bulkhead 120, an electrical wiring harness 130, a fuel tank and fuel lines 140, and cabin flooring fabric 150. Other materials may include, by way of non-limiting examples, seat foam, headliner material, dashboard materials, underhood insulation materials, etc.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the claims.

What is claimed is:

1. A flame retardant system, comprising:

a flame retardant material incorporated into a matrical sorbent material that is incorporated into a substrate;

wherein the matrical sorbent material is configured to release the flame retardant material upon exposure to an elevated temperature; and wherein the matrical sorbent material is a microporous aluminum-based Metal Organic Framework (MOF) material having a pore volume of at least 1.0 mL/g and a decomposition temperature near 300° C. to release the flame retardant material.

2. The flame retardant system of claim 1, wherein the flame retardant material comprises huntite in combination with hydromagnesite.

3. The flame retardant system of claim 1, wherein the flame retardant material comprises huntite in combination with aluminum hydroxide.

4. The flame retardant system of claim 1, wherein the flame retardant material comprises huntite in combination with magnesium hydroxide.

5. A flame retardant system, comprising:

a flame retardant material incorporated into a matrical sorbent material that is incorporated into a substrate;

wherein the matrical sorbent material is configured to release the flame retardant material upon exposure to an elevated temperature; and wherein the matrical sorbent material is a zirconium-based Metal Organic Framework (MOF) material having a pore volume of at least 1.0 mL/g and a decomposition temperature near 300° C. to release the flame retardant material.

6. The flame retardant system of claim 1, wherein the MOF material comprises a thermally stable MOF having a pore volume of at least 3.0 mL/g and a decomposition temperature near 300° C. to release the flame retardant material.

7. The flame retardant system of claim 1, wherein the MOF material comprises an isoreticular MOF having a pore volume of at least 3.0 mL/g and a decomposition temperature near 300° C. to release the flame retardant material.

8. The flame retardant system of claim 5, wherein the matrical sorbent material comprises a zeolite material having a pore volume of at least 1.0 mL/g and a release temperature near 300° C. to release the flame retardant material.

9. The flame retardant system of claim 1, wherein the matrical sorbent material is configured to release the flame retardant material upon exposure to a temperature that is greater than 250° C.

10. The flame retardant system of claim 1, wherein the substrate comprises a meshed fabric.

11. The flame retardant system of claim 1, wherein the substrate comprises a liquified coating material.

12. The flame retardant system of claim 11, wherein the liquified coating material incorporating the flame retardant material that is incorporated into the matrical sorbent material is applied to a composite material.

13. The flame retardant system of claim 11, wherein the liquified coating material incorporating the flame retardant material incorporated into the matrical sorbent material is applied to a solid surface.

14. The flame retardant system of claim 1, wherein the substrate incorporating the flame retardant material that is incorporated into the matrical sorbent material comprises a cable sheath.

15. The flame retardant system of claim 1, wherein the substrate incorporating the flame retardant material that is incorporated into the matrical sorbent material comprises a thin film arranged on a flexible tape material.

16. The flame retardant system of claim 1, wherein the substrate incorporating the flame retardant material that is incorporated into the matrical sorbent material comprises a thin film arranged on a foil wrap material.

17. The flame retardant system of claim 1, wherein the MOF material comprises MIL-53 having a structure with inorganic [M-OH] chains that are connected to four neighboring inorganic chains by therephthalate-based linker molecules.

18. The flame retardant system of claim 5, wherein the zirconium-based Metal Organic Framework (MOF) material comprises one of UiO-66 or UiO-67.

* * * * *